US008169156B2

(12) United States Patent
Hsu et al.

(10) Patent No.: US 8,169,156 B2
(45) Date of Patent: May 1, 2012

(54) CONTROL METHOD CAPABLE OF PREVENTING FLICKER EFFECT AND LIGHT EMITTING DEVICE THEREOF

(75) Inventors: Kuo-Ching Hsu, Hsinchu (TW); Tsung-Hau Chang, Hsinchu (TW); Chin-Hsun Hsu, Taipei County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 351 days.

(21) Appl. No.: 12/625,576

(22) Filed: Nov. 25, 2009

(65) Prior Publication Data

US 2011/0037410 A1 Feb. 17, 2011

(30) Foreign Application Priority Data

Aug. 17, 2009 (TW) ..... 98127570 A

(51) Int. Cl.
*G05F 1/00* (2006.01)

(52) U.S. Cl. ..... 315/291; 315/247; 315/224; 315/185 S; 315/312

(58) Field of Classification Search ..... 315/291, 315/224, 225, 247, 246, 307–326, 185 S
See application file for complete search history.

(56) References Cited

U.S. PATENT DOCUMENTS

| | | | | |
|---|---|---|---|---|
| 7,843,150 | B2 * | 11/2010 | Wang et al. | 315/307 |
| 2010/0001657 | A1 * | 1/2010 | Chen | 315/291 |
| 2011/0227497 | A1 * | 9/2011 | Hu et al. | 315/224 |

* cited by examiner

*Primary Examiner* — Tuyet Thi Vo
(74) *Attorney, Agent, or Firm* — Winston Hsu; Scott Margo

(57) ABSTRACT

A control method capable of preventing flicker effect for a light source module includes detecting variation situations of a driving current passing through the light source module to generate a current detection signal, adjusting a variable reference voltage according to the current detection signal, obtaining a feedback voltage from the light source module, generating a voltage control signal according to the feedback voltage and the variable reference voltage, and generating an output voltage according to the voltage control signal to drive the light source module.

38 Claims, 8 Drawing Sheets

CONTROL METHOD CAPABLE OF PREVENTING FLICKER EFFECT AND LIGHT EMITTING DEVICE THEREOF

BACKGROUND OF THE INVENTION

1. Field of the Invention

The present invention relates to control method and device thereof, and more particularly, to a control method capable of preventing flicker effect and a related light emitting device.

2. Description of the Prior Art

Light emitting diodes (LEDs) offer advantages of energy savings, long device lifetime, no mercury used, high achievable color gamut, without idle time, and fast response speed, so that LED technology is widely applied in fields of display and illumination. In addition, compared with a conventional light source device, light emitting diodes are suitable for fabrication as a tiny device or an array device, such as in traffic lights, outdoor displays, backlight modules of liquid crystal displays, PDAs, notebooks, or mobile phones with features of small size, shock resistance, ease of mass production, and high applicability.

Please refer to FIG. 1, which is a schematic diagram of an LED driving device 10 according to the prior art. The LED driving device 10 is utilized for driving a light source module 102 which includes a plurality of LED groups $C_1$ to $C_m$ arranged in parallel. The LED driving device 10 includes a voltage converter 104, a current source 106, a pulse modulation unit 108, and a control unit 110. The voltage converter 104 is utilized for providing an output voltage $V_D$ to the light source module 102. The current source 106 is utilized for providing driving currents $I_{D1}$ to $I_{DM}$ for LED groups $C_1$ to $C_m$ to drive the light source module 102. The pulse modulation unit 108 is utilized for dimming according to a dimming signal $S_D$. In general, a plurality of headroom voltages $V_{HR1}$ to $V_{HRm}$ exist on each path of the LED groups $C_1$ to $C_m$. The headroom voltages $V_{HR1}$ to $V_{HRm}$ represent the voltage value across the current source 106 on each path of the LED groups $C_1$ to $C_m$, i.e. available voltage value for the current source 106 on each LED group path. In practice, the currents passing through the LEDs can usually be kept constant, i.e. the driving currents $I_{D1}$ to $I_{DM}$ are fixed, for steady brightness control and power consumption of the LEDs. However, the voltages across the LEDs may not be all the same due to non-ideal factors in the manufacturing process or other reasons, and the headroom voltages $V_{HR1}$ to $V_{HRm}$ are not the same correspondingly. In such a condition, the headroom voltage may be too high or too low, and will result in some unwanted effects. For example, if the headroom voltage is too high, the power consumption of the current source will increase, and the power conversion efficiency will be reduced. If the headroom voltage is not high enough, the current source will operate in an improper state, and cannot keep constant current sink, even to the point of not being able to provide the required driving current to the LED, and the LED will not conduct.

Therefore, as shown in FIG. 1, in the conventional technology, the voltage converter 104 may be controlled to change the output voltage $V_D$ by the control unit 110 in negative feedback form in order to obtain appropriate headroom voltages. The control unit 110 includes a voltage selector 112, an error amplifier 114, and a conversion controller 116. The voltage selector 112 is coupled to the output terminal of each LED group $C_1$ to $C_m$ for selecting one of the headroom voltages $V_{HR1}$ to $V_{HRm}$ as the feedback voltage $V_{FB}$. Again, the feedback voltage $V_{FB}$ and a predetermined reference voltage $V_{REF}$ are inputted to the positive end and negative end of respectively. The error amplifier 114 generates an error voltage signal $S_E$ according to the difference between the feedback voltage $V_{FB}$ and the predetermined reference voltage $V_{REF}$. Furthermore, the conversion controller 116 generates a voltage control signal $S_C$ according to the error voltage signal $S_E$ for control the conversion process of the voltage converter 104. Thus, as the headroom voltages $V_{HR1}$ to $V_{HRm}$ corresponding to each LED group $C_1$ to $C_m$ are too low, the error amplifier 114 generates the error voltage signal $S_E$ sent to the conversion controller 116, and the conversion controller 116 generates the voltage control signal $S_C$ accordingly to control the voltage converter 104 to increase the output voltage $V_D$. As a result, as the driving currents $I_{D1}$ to $I_{DM}$ are fixed, the headroom voltages $V_{HR1}$ to $V_{HRm}$ will not vary accordingly. On the other hand, the headroom voltages $V_{HR1}$ to $V_{HRm}$ are proportional to the output voltage $V_D$. Therefore, the control unit 110 is able to control the output voltage $V_D$ to be increased so that the headroom voltages $V_{HR1}$ to $V_{HRm}$ increase correspondingly, and vice versa. Therefore, under the steady driving currents $I_{D1}$ to $I_{DM}$ provided, the LED driving circuit 10 can lock the headroom voltages $V_{HR1}$ to $V_{HRm}$ within an appropriate range, such as the predetermined reference voltage $V_{REF}$, by the control unit 110.

However, current variation situations may occur often in the currents passing through the LEDs in many cases. For example, during the dimming process, the brightness of the LEDs can be changed by adjusting the currents passing through the LEDs (i.e. by adjusting the driving currents $I_{D1}$ to $I_{DM}$), so that the voltages across the LEDs vary correspondingly. But, the LED driving circuit 10 adjusts the output voltage $V_D$ by only comparing the output voltage $V_D$ with a fixed predetermined reference voltage, which results in consuming too much feedback tracking time for adjusting the output voltage $V_D$. In other words, the output voltage $V_D$ can not be arranged to an appropriate voltage level immediately, and the headroom voltages of the current source 106 become too low to provide sufficient driving currents, so that flicker effects occur.

SUMMARY OF THE INVENTION

It is therefore an objective of the present invention to provide a control method capable of preventing flicker effect and light emitting device.

The present invention discloses a control method capable of preventing flicker effect for a light source module. The control method includes detecting variation situations of a driving current passing through the light source module to generate a current detection signal; adjusting a variable reference voltage according to the current detection signal; obtaining a feedback voltage from the light source module; generating a voltage control signal according to the feedback voltage and the variable reference voltage; and generating an output voltage according to the voltage control signal to drive the light source module.

The present invention further discloses an LED device which includes a voltage converter, a light source module, a variable current source, and a control unit. The voltage converter is utilized for converting an input voltage into an output voltage according to a voltage control signal. The light source module is coupled to the voltage converter. The variable current source is coupled to the light source module for providing a driving current to drive the light source module. The control unit is coupled to the light source module and the voltage converter for obtaining a feedback voltage from the light source module and detecting variation situations of the driving current passing through the light source module to generate a current detection signal. The control unit adjusts a variable reference voltage according to the current detection signal and generates the voltage control signal according to the feedback voltage and the variable reference voltage to the voltage converter.

The present invention further discloses a control method capable of preventing flicker effect for a light source module. The control method includes detecting variation situations of a driving current provided by a variable current source to generate a current detection signal; adjusting a variable reference voltage according to the current detection signal; obtaining a feedback voltage from the light source module; generating a voltage control signal according to the feedback voltage and the variable reference voltage; and generating an output voltage according to the voltage control signal to drive the light source module.

The present invention further discloses an LED device which includes a voltage converter, a light source module, a variable current source, and a control unit. The voltage converter is utilized for converting an input voltage into an output voltage according to a voltage control signal. The light source module is coupled to the voltage converter. The variable current source is coupled to the light source module for generating a driving current to drive the light source module. The control unit is coupled to the variable current source and the voltage converter for obtaining a feedback voltage from the light source module and detecting variation situations of the driving current provided by the variable current source to generate a current detection signal. The control unit adjusts a variable reference voltage according to the current detection signal and generates the voltage control signal according to the feedback voltage and the variable reference voltage to the voltage converter.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
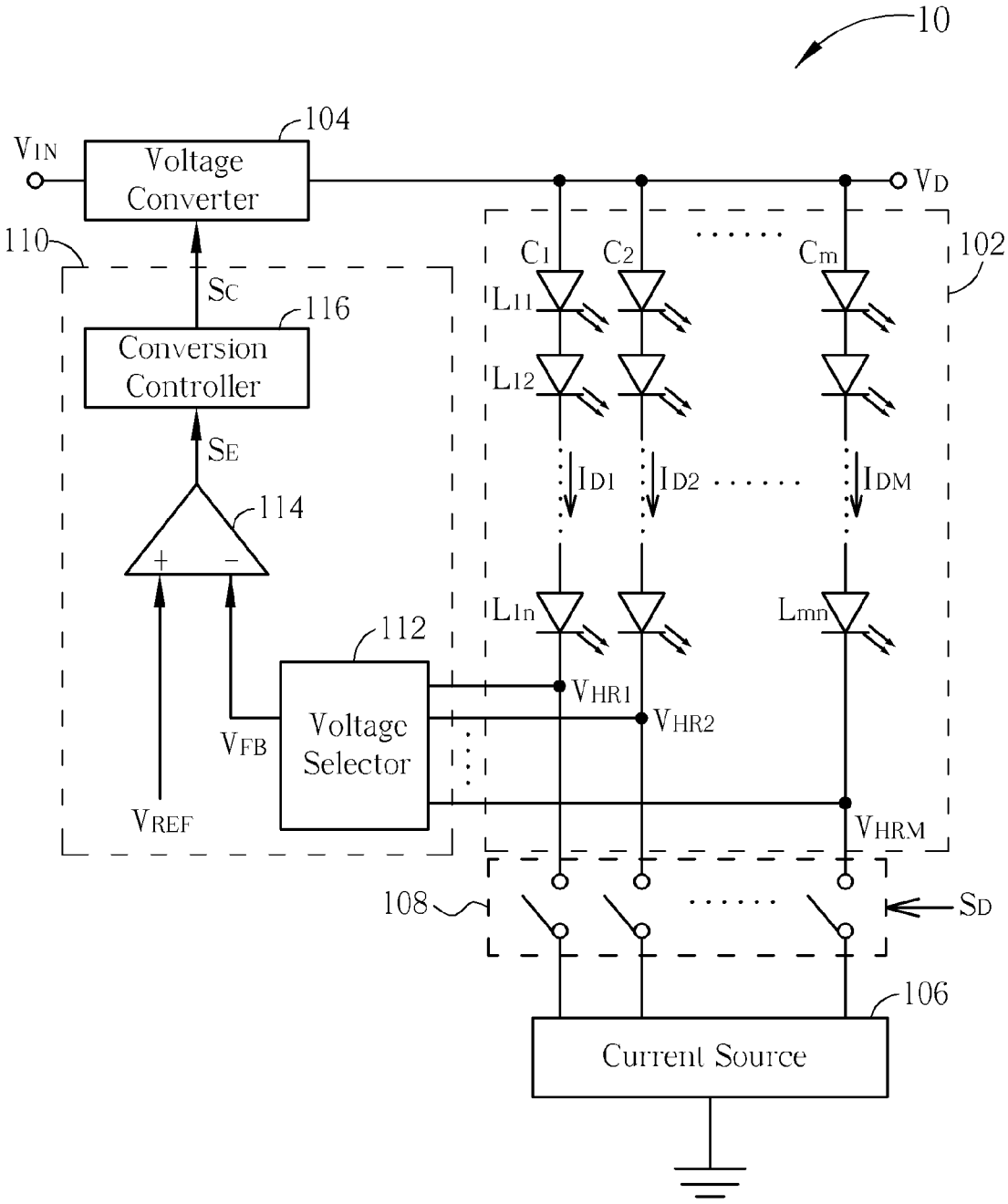
FIG. 1 PRIOR ART
FIG. 1 is a schematic diagram of an LED driving device according to the prior art.
Figure 2:
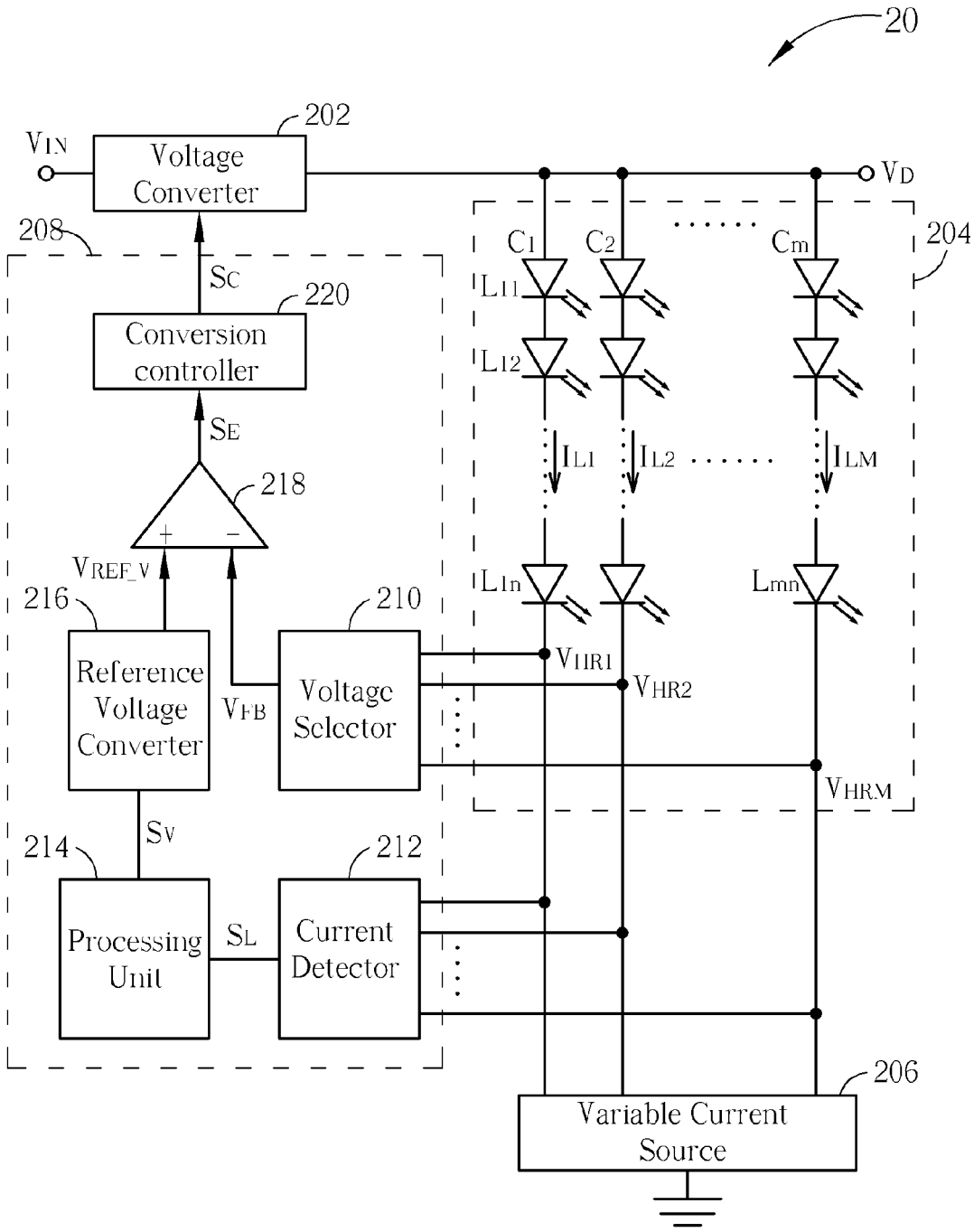
FIG. 2 is a schematic diagram of an LED device according to first embodiment of the present invention.

Please refer to FIG. 2, which is a schematic diagram of an LED device 20 according to an embodiment of the present invention. The LED device 20 can be applied to any kind of light source, which includes a voltage converter 202, a light source module 204, a variable current source 206, and a control unit 208. The voltage converter 202 is utilized for converting an input voltage $V_{IN}$ into an output voltage $V_D$ according to a voltage control signal $S_C$ for the light source module 204. The light source module 204 is coupled to the voltage converter 202. Note that, in the embodiment of the present invention, the light source module 204 includes a plurality of LED groups $C_1$ to $C_m$, and this should not be a limitation of the present invention. In other words, the light emitting component 102 can also have one LED group only. On the other hand, since the LED is a current driven component, the brightness of the LED is proportional to the driving current. Therefore, each LED group includes at least one LED in series, such as having n LEDs in each LED group, and the number of the LEDs included in each LED group must be the same in order to allow the current through each LED to be identical and result in the same brightness. As shown in FIG. 2, the variable current source 206 is coupled to the light source module 204 for providing load currents $I_{L1}$ to $I_{Lm}$ for LED groups $C_1$ to $C_m$ to drive the light source module 204. The control unit 208 is coupled to the light source module 204 and the voltage converter 202 for obtaining a feedback voltage $V_{FB}$ from the light source module 204 and detecting variation situations of the load currents $I_{L1}$ to $I_{LM}$ passing through the LED groups $C_1$ to $C_m$ to generate a current detection signal $S_L$. Furthermore, the control unit 208 adjusts a variable reference voltage $V_{REF_V}$ according to the current detection signal $S_L$ and generates the voltage control signal $S_C$ sent to the voltage converter 202 according to the feedback voltage $V_{FB}$ and the variable reference voltage $V_{REF_V}$. As can been seen, the control unit 208 can detect variation situations of the load currents $I_{L1}$ to $I_{LM}$ passing through the light source module 204 in real-time and dynamically adjust the variable reference voltage $V_{REF_V}$ accordingly to control the voltage converter 202 to convert to the appropriate output voltage $V_D$ for the light source module 204.

The following further elaborates the control unit 208 shown in FIG. 2. Please further refer to FIG. 2. The control unit 208 includes a voltage selector 210, a current detector 212, a processing unit 214, a reference voltage converter 216, an error amplifier 218, and a conversion controller 220. The voltage selector 210 is coupled to the light source module 204 for selecting the feedback voltage $V_{FB}$ from a plurality of headroom voltages $V_{HR1}$ to $V_{HRM}$ corresponding to the LED groups $C_1$ to $C_m$. The current detector 212 is coupled to the light source module 204 for detecting variation situations of the load currents $I_{L1}$ to $I_{Lm}$ to generate the current detection signal $S_L$. The processing unit 214 is coupled to the current detector 212 for generating a reference voltage converting signal $S_V$ according to the current detection signal $S_L$. The reference voltage converter 216 is coupled to the processing unit 214 for generating the variable reference voltage $V_{REF_V}$ according to the reference voltage converting signal $S_V$. Therefore, as the current detection signal $S_L$ indicates the current variations of the load currents $I_{L1}$ to $I_{Lm}$ occur, the processing unit 214 is capable of informing the reference voltage converter 216 of variation situations via the reference voltage converting signal $S_V$ so that the reference voltage converter 216 generates the required variable reference voltage $V_{REF_V}$ accordingly. For example, when the current detection signal $S_L$ indicates the current variations of the load currents $I_{L1}$ to $I_{Lm}$ become greater, the processing unit 214 is able to notify the reference voltage converter 216. After that, the reference voltage converter 216 can increase the variable reference voltage $V_{REF_V}$ accordingly. When the current detection signal $S_L$ indicates the current variations of the load currents $I_{L1}$ to $I_{LM}$ become smaller, the processing unit 214 is able to notify the reference voltage converter 216, so that the reference voltage converter 216 can decrease the variable reference voltage $V_{REF_V}$ accordingly.

Moreover, a positive end and a negative end of the error amplifier 218 are coupled to the reference voltage generator 216 and the voltage selector 210 respectively. The error amplifier 218 generates an error voltage signal $S_E$ according to the feedback voltage $V_{FB}$ and the variable reference voltage $V_{REF_V}$ and outputs the error voltage signal $S_E$ through an output end of the error amplifier 218. The conversion controller 220 is coupled to the output end of the error amplifier 218 and the voltage converter 202 for generating the voltage control signal $S_C$ according to the error voltage signal $S_E$ for the voltage converter 202. In such a condition, regardless of whether the feedback voltage $V_{FB}$ is greater or less than the variable reference voltage $V_{REF_V}$, the error amplifier 218 generates the error voltage signal $S_E$ according to the difference between the feedback voltage $V_{FB}$ and the variable reference voltage $V_{REF_V}$ in order to inform the conversion controller 220. The conversion controller 220 then generates the corresponding voltage control signal $S_C$ for increasing or decreasing the output voltage $V_D$ accordingly. As can been seen, the control unit 208 can detect in real-time variation situations of the load currents $I_{L1}$ to $I_{LM}$ of the light source module 204, and further adjust the variable reference voltage $V_{REF_V}$ dynamically for instantaneously tracking the proper output voltage $V_D$ through feedback.

In the prior art, when current variation occurs, the headroom voltage may be constricted to be too small, so that the variable current source 206 can not provide enough load current and a flicker effect occurs, or the headroom voltage be constricted to be too high so that the variable current source 206 consumes too much power through the variable current source 206. Therefore, the present invention can detect in real-time variation situations of the load currents $I_{L1}$ to $I_{LM}$ passing through the LED groups $C_1$ to $C_m$ and dynamically adjust the variable reference voltage $V_{REF_V}$ accordingly to control the voltage converter 202 to convert to the appropriate output voltage $V_D$. As a result, the present invention can prevent the headroom voltage from being constricted to be too small to avoid the flicker effect, and the present invention can also prevent the headroom voltage from being constricted to be too high to enhance voltage conversion efficiency.

Figure 3:
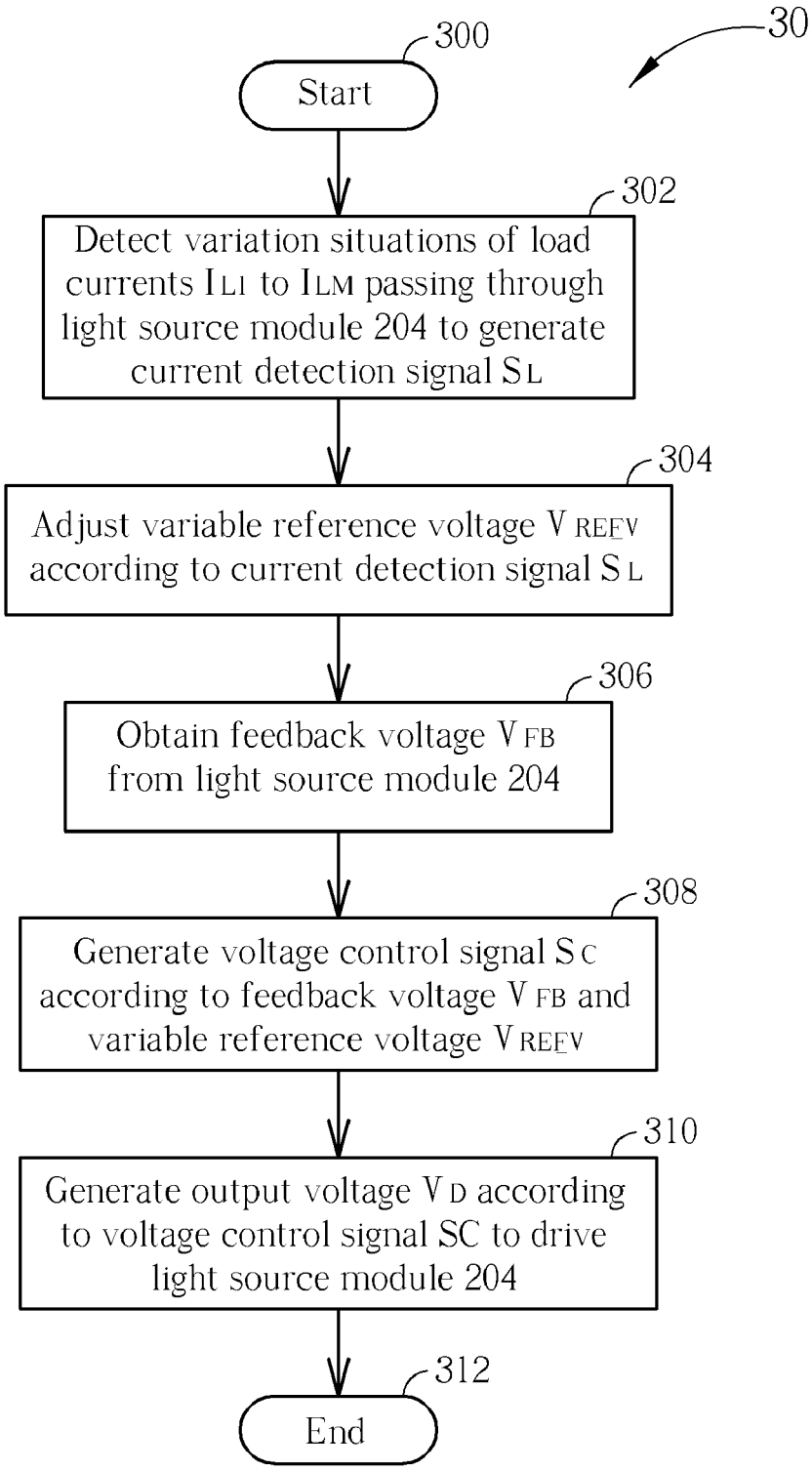
FIG. 3 is a schematic diagram of a procedure according to first embodiment of the present invention.

As to the operating method of the LED device 20, please refer to FIG. 3. FIG. 3 is a schematic diagram of a procedure 30 according to an embodiment of the present invention. The procedure 30 comprises the following steps:

Step 300: Start.

Step 302: Detect variation situations of load currents $I_{L1}$ to $I_{LM}$ passing through light source module 204 to generate current detection signal $S_L$.

Step 304: Adjust variable reference voltage $V_{REF_V}$ according to current detection signal $S_L$.

Step 306: Obtain feedback voltage $V_{FB}$ from light source module 204.

Step 308: Generate voltage control signal $S_C$ according to feedback voltage $V_{FB}$ and variable reference voltage $V_{REF_V}$.

Step 310: Generate output voltage $V_D$ according to voltage control signal $S_C$ to drive light source module 204.

Step 312: End.

The procedure 40 is utilized for illustrating the implementation of the LED device 20. Related variations and the detailed description can be referred from the foregoing description, so as not to be narrated herein.

Figure 4:
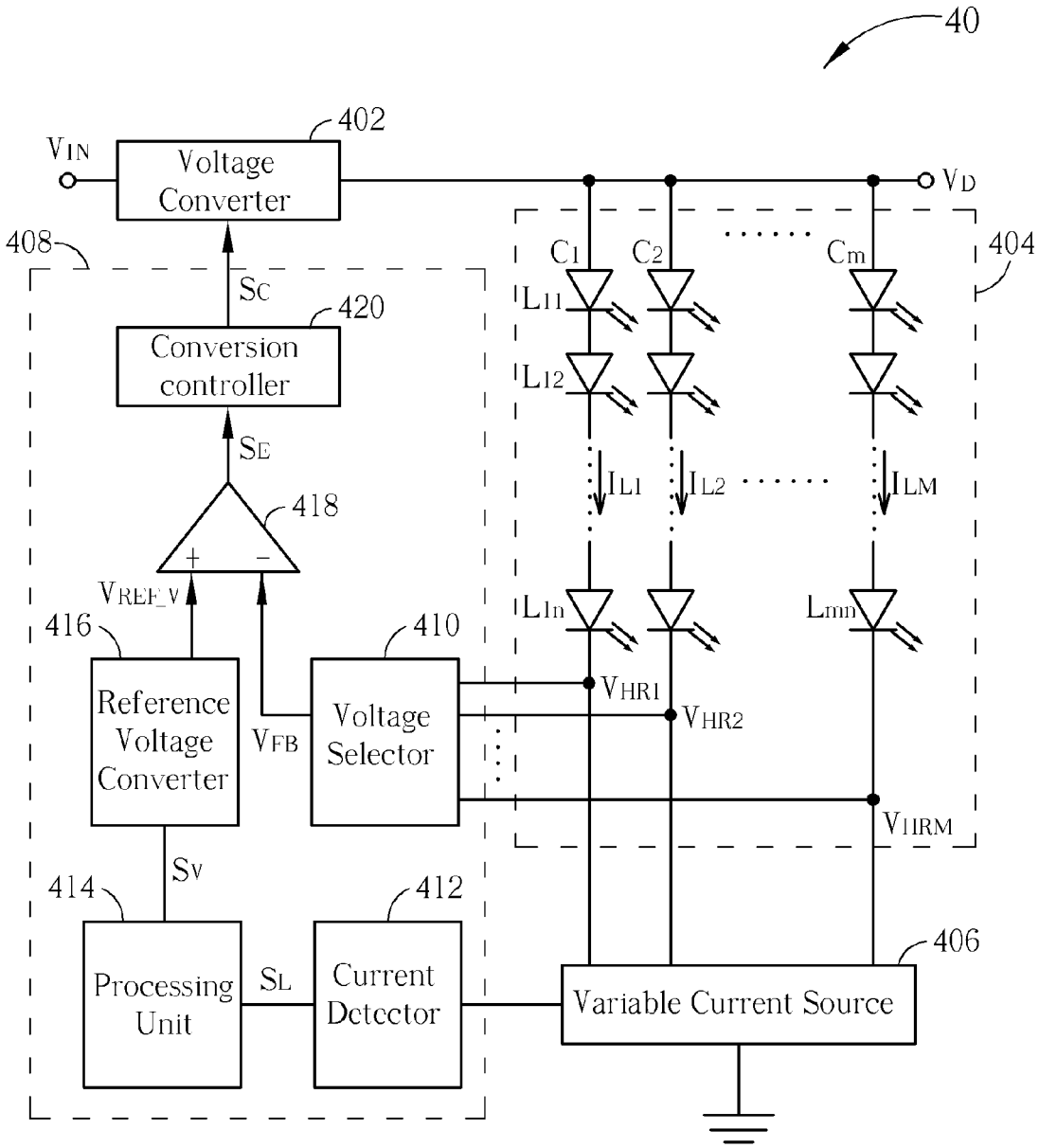
FIG. 4 is a schematic diagram of an LED device according to second embodiment of the present invention.
Figure 5:
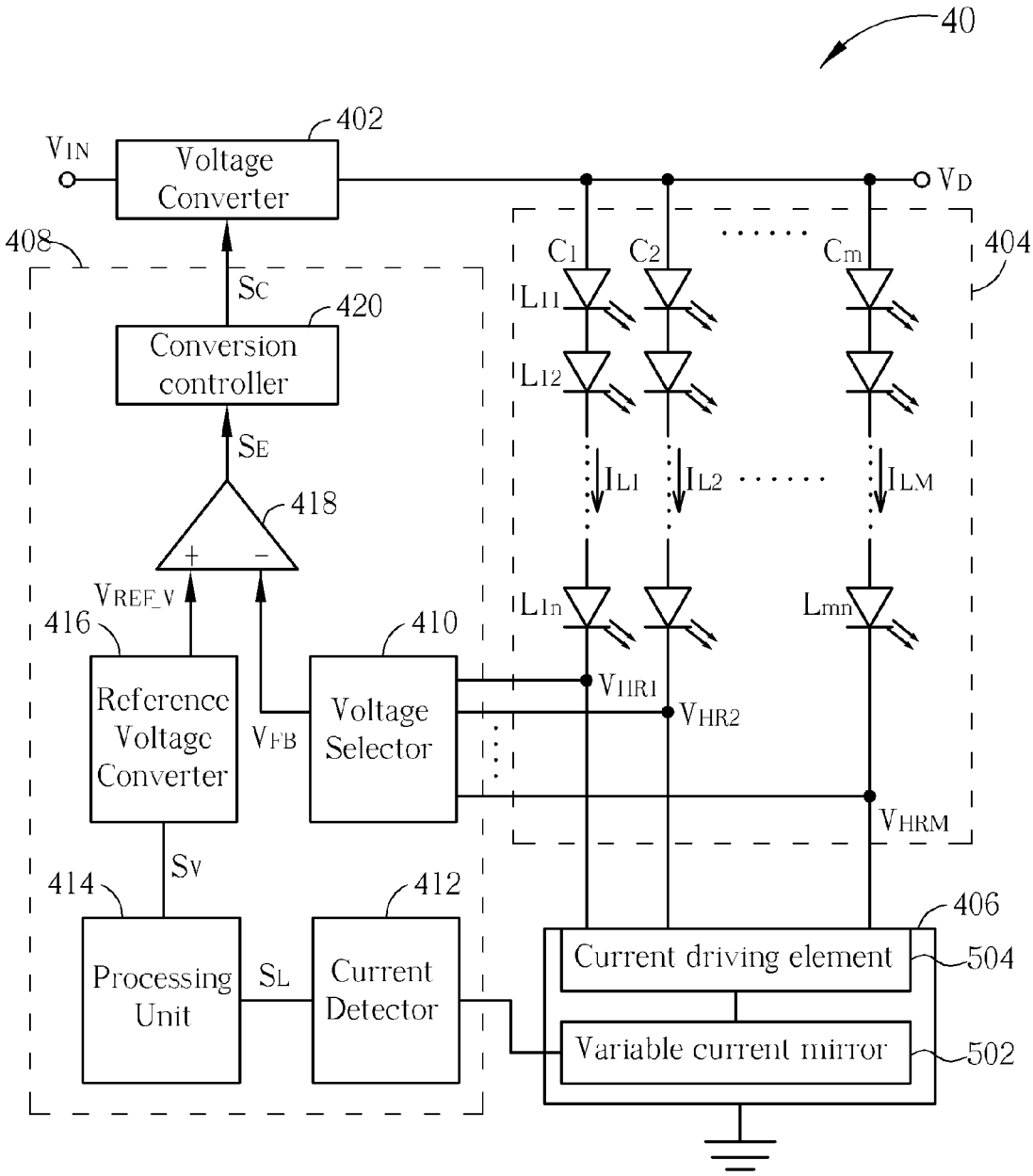
FIG. 5 is a schematic diagram of a variable current source shown in FIG. 4 according to second embodiment of the present invention.

In addition, the control unit can also detect current variation situations of the variable current source and dynamically adjust the variable reference voltage $V_{REF_V}$ accordingly to control the voltage converter to convert to the appropriate output voltage $V_D$. Please refer to FIG. 4, which is a schematic diagram of an LED device 40 according to an embodiment of the present invention. Please note that elements of the LED device 40 shown in FIG. 4 with the same reference numerals as those in the LED device 20 shown in FIG. 2 have similar operations and functions and further description thereof is omitted for brevity. The interconnections of the units are as shown in FIG. 4. The LED device 40 includes a voltage converter 402, a light source module 404, a variable current source 406, and a control unit 408. The control unit 408 includes a voltage selector 410, a current detector 412, a processing unit 414, a reference voltage converter 416, an error amplifier 418, and a conversion controller 420. Different from the LED device 20 shown in FIG. 2 is that current detector 412 shown in FIG. 4 is coupled to the variable current source 406. The current detector 412 is utilized for detecting variation situations of the load current generated by the variable current source 406 to generate the current detection signal $S_L$ and further to adjust the variable reference voltage $V_{REF_V}$. Furthermore, please refer to FIG. 5. The variable current source 406 further includes a variable current mirror 502 and a current driving element 504. The variable current mirror 502 is coupled to the current detector 412 for generating the load currents $I_{L1}$~$I_{Lm}$. The current driving element 504 is coupled to the variable current mirror 502 and the LED groups $C_1$ to $C_m$ of the light source module 404 for controlling the load currents $I_{L1}$~$I_{Lm}$ to be provided to the LED groups $C_1$ to $C_m$. In other words, the control unit 408 can directly monitor the current variation on the variable current source 406 in order to convert to the appropriate output voltage $V_D$ at once. On the other hand, in the embodiment of the present invention, the control unit 408 can be directly coupled to the variable current mirror 502 for detecting the current variation of the load currents $I_{L1}$~$I_{Lm}$, and this should not be limited. The control unit 408 can also be directly coupled to other components of the variable current source 406 (such as the current driving element 504) and detect the current variation at other components of the variable current source 406. Thus, the control unit 408 can detect the current variation at any component of the variable current source 406 to obtain the variation situations of the load currents $I_{L1}$~$I_{Lm}$. Moreover, regarding implementation, the control unit 408 and the variable current source 406 can be implemented on the same chip, so that the above mentioned operation method will be realized in the chip without external circuits. In such a condition, the purpose of preventing the flicker effect may be achieved more immediately.

Figure 6:
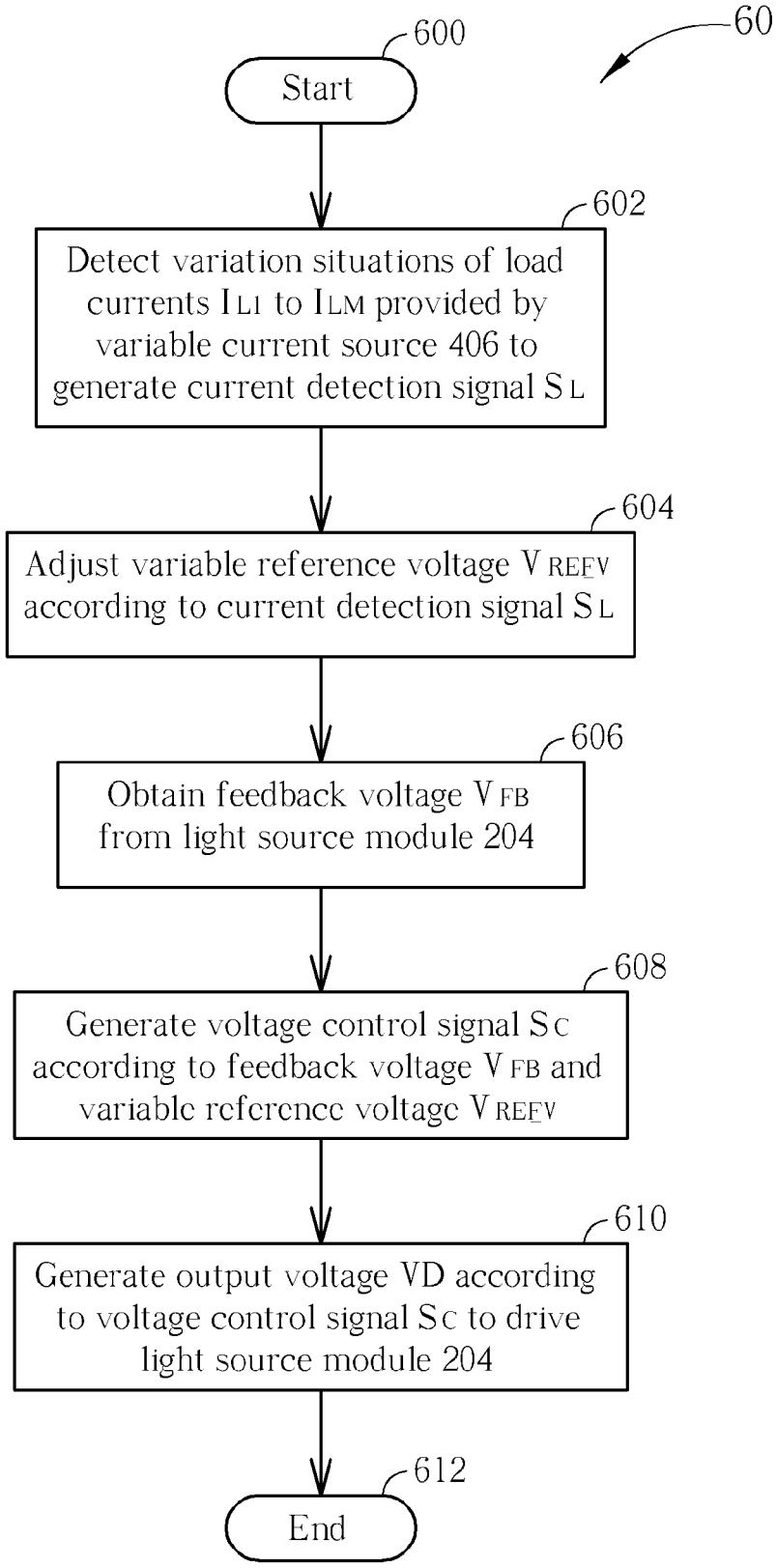
FIG. 6 is a schematic diagram of a procedure according to second embodiment of the present invention.

As to the operating method of the LED device 40, please refer to FIG. 6. FIG. 6 is a schematic diagram of a procedure 60 according to an embodiment of the present invention. The procedure 60 comprises the following steps:

Step 600: Start.

Step 602: Detect variation situations of load currents $I_{L1}$ to $I_{LM}$ provided by variable current source 406 to generate current detection signal $S_L$.

Step 604: Adjust variable reference voltage $V_{REF_V}$ according to current detection signal $S_L$.

Step 606: Obtain feedback voltage $V_{FB}$ from light source module 204.

Step 608: Generate voltage control signal $S_C$ according to feedback voltage $V_{FB}$ and variable reference voltage $V_{REF_V}$.

Step 610: Generate output voltage $V_D$ according to voltage control signal $S_C$ to drive light source module 204.

Step 612: End.

The procedure 60 is utilized for illustrating the implementation of the LED device 40. Related variations and the detailed description can be referred from the foregoing description, so as not to be narrated herein.

Figure 7:
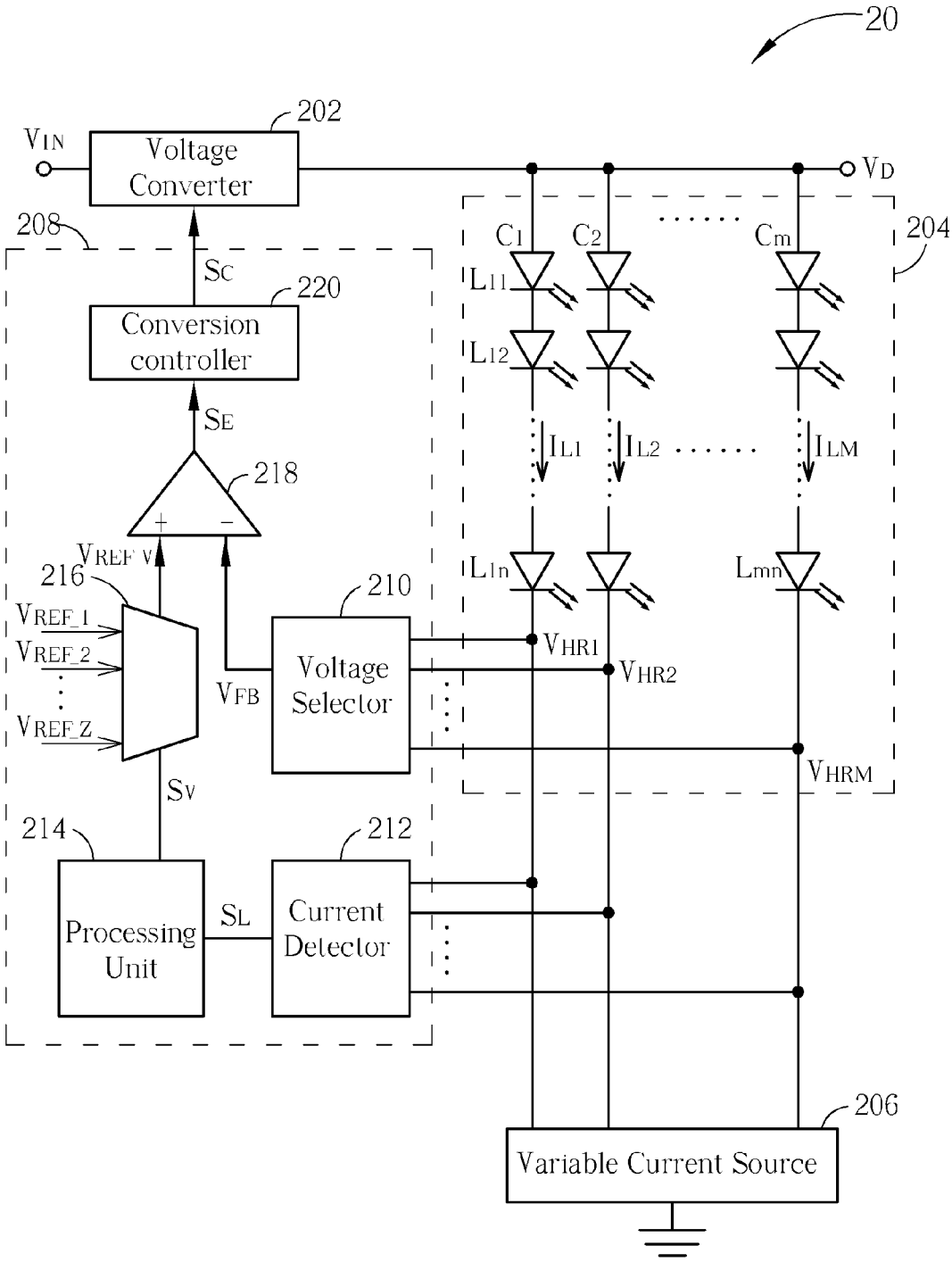
FIG. 7 is a schematic diagram of a reference voltage converter shown in FIG. 2 according to second embodiment of the present invention.
Figure 8:
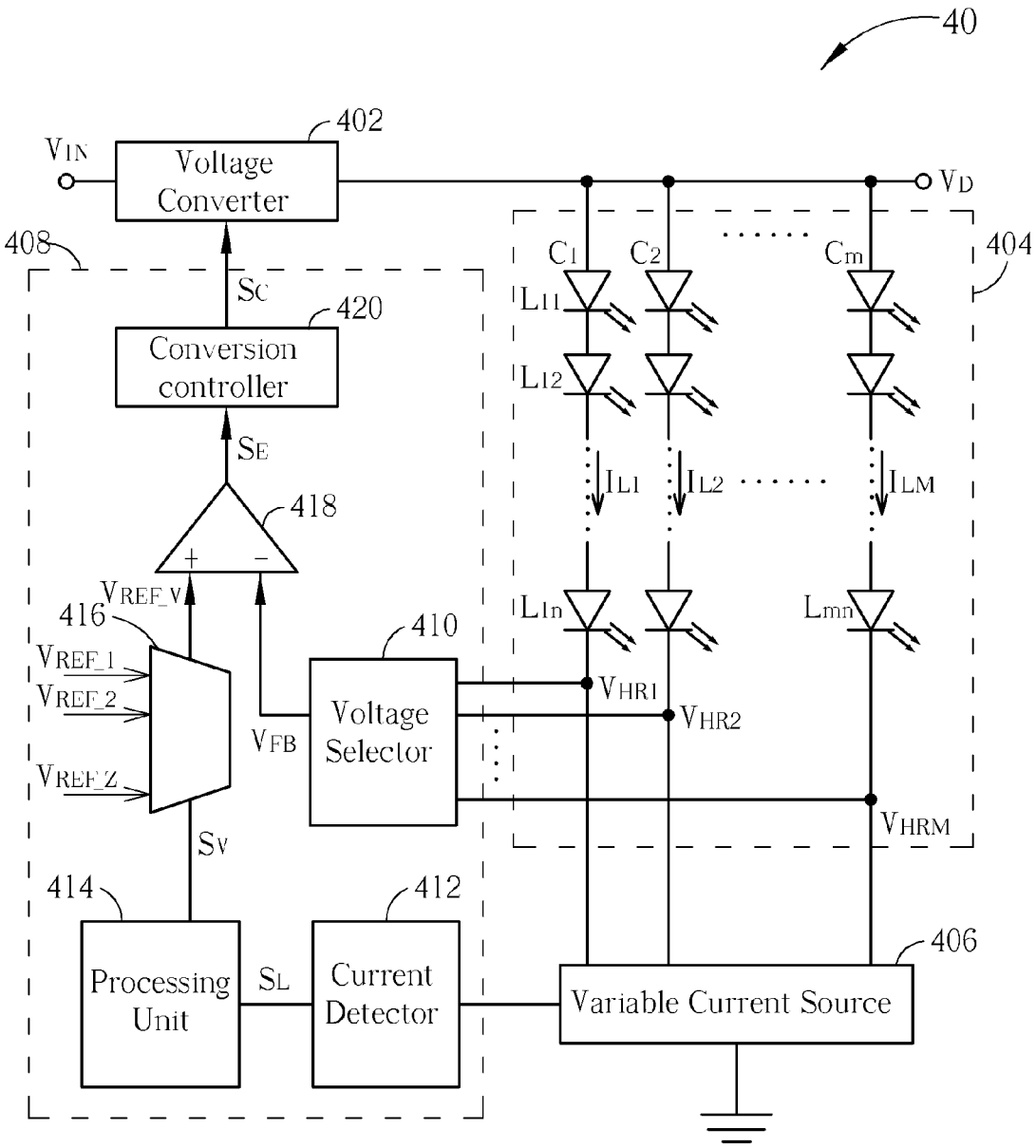
FIG. 8 is a schematic diagram of a reference voltage converter shown in FIG. 4 according to second embodiment of the present invention.

Note that the above mentioned embodiments are exemplary embodiments of the present invention, and those skilled in the art can make alternations and modifications accordingly. For example, the reference voltage converters 216 and 416 can provide various voltage values by any method in accordance with requirements for providing the proper variable reference voltage $V_{REF_V}$. As shown in FIG. 7 and FIG. 8, the reference voltage converters 216 and 416 can be multiplexers 702 and 802, which switch to the corresponding variable reference voltage $V_{REF_V}$ from predetermined reference voltages $V_{REF_1}$ to $V_{REF_Z}$ according to the reference voltage converting signal $S_V$. In addition, the voltage selectors 210 and 410 can select the feedback voltage $V_{FB}$ among the headroom voltages $V_{HR1}$ to $V_{HRM}$ according to any rule, such as the voltage selectors 210 and 410 can select the lowest headroom voltage from the headroom voltages $V_{HR1}$ to $V_{HRm}$ as the feedback voltage $V_{FB}$. On the other hand, the processing units 214 and 414 can calculate a suitable reference voltage value with arithmetic and logical operations according to the current variations of the load currents $I_{L1}$ to $I_{LM}$. For example the processing units 214 and 414 are able to estimate a corresponding reference voltage value according to amount of LED groups having current variation, amount of current variation, or amount of average variation of overall load currents. Moreover, the processing units 214 and 414 may generate the current detection signal $S_L$ according to the current variation every specific time interval or whenever at least one load has a current variation situation. The variable current source can vary the current provided to the light source module according to a dimming signal to adjust the brightness of the LED on the light source module.

In summary, the present invention can detect in real-time variation situations of the load currents $I_{L1}$ to $I_{LM}$ of the light source modules 204, 404 and further adjust the variable reference voltage $V_{REF_V}$ dynamically for converting the appropriate output voltage $V_D$ for the light source modules 204, 404 instantaneously. As a result, when current variation occurs, the present invention can prevent the headroom voltage from being constricted to be too small to avoid the flicker effect, and also prevent the headroom voltage from being constricted to be too high to enhance voltage conversion efficiency.

Those skilled in the art will readily observe that numerous modifications and alterations of the device and method may be made while retaining the teachings of the invention.

What is claimed is:

1. A control method capable of preventing flicker effect in a light source module, the control method comprising:

detecting variation situations of a driving current passing through the light source module to generate a current detection signal;

adjusting a variable reference voltage according to the current detection signal;

obtaining a feedback voltage from the light source module;

generating a voltage control signal according to the feedback voltage and the variable reference voltage; and generating an output voltage according to the voltage control signal to drive the light source module.

2. The control method of claim 1, wherein the light source module comprises a plurality of light-emitting diode (LED) groups and the driving current comprises a plurality of load currents passing through each LED group respectively.

3. The control method of claim 2, wherein the step of detecting variation situations of the driving current passing through the light source module to generate the current detection signal comprises:

generating the current detection signal according to the variation situations of at least one load current of the plurality of load currents having current variation when current variation of the at least one load current is detected.

4. The control method of claim 2, wherein the step of obtaining the feedback voltage from the light source module comprises:

selecting the lowest headroom voltage from a plurality of headroom voltages corresponding to the plurality of LED groups as the feedback voltage.

5. The control method of claim 1, wherein the feedback voltage is selected from headroom voltages corresponding to the light source module.

6. The control method of claim 1, wherein the step of adjusting the variable reference voltage according to the current detection signal comprises:

increasing the variable reference voltage when the current detection signal indicates the driving current becomes greater.

7. The control method of claim 1, wherein the step of adjusting the variable reference voltage according to the current detection signal comprises:

decreasing the variable reference voltage when the current detection signal indicates the driving current becomes smaller.

8. The control method of claim 1, wherein the step of adjusting the variable reference voltage according to the current detection signal comprises:

generating a reference voltage converting signal according to the current detection signal; and generating the variable reference voltage according to the reference voltage converting signal.

9. A light-emitting diode (LED) device, comprising:

a voltage converter, for converting an input voltage into an output voltage according to a voltage control signal;

a light source module, coupled to the voltage converter;

a variable current source, coupled to the light source module, for providing a driving current to drive the light source module; and a control unit, coupled to the light source module and the voltage converter, for obtaining a feedback voltage from the light source module and detecting variation situations of the driving current passing through the light source module to generate a current detection signal;

wherein the control unit adjusts a variable reference voltage according to the current detection signal and generates the voltage control signal sent to the voltage converter according to the feedback voltage and the variable reference voltage.

10. The LED device of claim 9, wherein the light source module comprises a plurality of LED groups and the driving current is composed of a plurality of load currents passing through each LED group respectively.

11. The LED device of claim 10, wherein each LED group of the plurality of LED groups comprises a plurality of LEDs in series.

12. The LED device of claim 10, wherein the control unit generates the current detection signal according to the variation situations of at least one load current of the plurality of load currents having current variation when the current variation of the at least one load current is detected.

13. The LED device of claim 10, wherein the control unit selects the lowest headroom voltage from a plurality of headroom voltages corresponding to the plurality of LED groups as the feedback voltage.

14. The LED device of claim 9, wherein the control unit comprises:

a voltage selector, coupled to the light source module, for selecting the feedback voltage from a plurality of headroom voltages corresponding to the light source module;

a current detector, coupled to the light source module, for detecting variation situations of the driving current passing through the light source module to generate the current detection signal;

a processing unit, coupled to the current detector, for generating a reference voltage converting signal according to the current detection signal;

a reference voltage converter, coupled to the processing unit, for generating the variable reference voltage according to the reference voltage converting signal;

an error amplifier, coupled to the voltage selector and the reference voltage generator, for generating an error voltage signal according to the feedback voltage and the variable reference voltage; and a conversion controller, coupled to the error amplifier and the voltage converter, for generating the voltage control signal according to the error voltage signal for the voltage converter.

15. The LED device of claim 14, wherein the voltage selector selects the lowest headroom voltage from the plurality of headroom voltages as the feedback voltage.

16. The LED device of claim 14, wherein the processing unit increases the variable reference voltage when the current detection signal indicates the driving current becomes greater.

17. The LED device of claim 14, wherein the processing unit decreases the variable reference voltage when the current detection signal indicates the driving current becomes smaller.

18. A control method capable of preventing flicker effect in a light source module, the control method comprising:

detecting variation situations of a driving current provided by a variable current source to generate a current detection signal;

adjusting a variable reference voltage according to the current detection signal;

obtaining a feedback voltage from the light source module;

generating a voltage control signal according to the feedback voltage and the variable reference voltage; and generating an output voltage according to the voltage control signal to drive the light source module.

19. The control method of claim 18, wherein the light source module comprises a plurality of light-emitting diode (LED) groups and the driving current is composed of a plurality of load currents passing through each LED group respectively.

20. The control method of claim 19, wherein the step of detecting variation situations of the driving current provided by the variable current source to generate the current detection signal comprises:

generating the current detection signal according to the variation situations of at least one load current of the plurality of load currents having current variation when the current variation of the at least one load current is detected.

21. The control method of claim 19, wherein the step of obtaining the feedback voltage from the light source module comprises:

selecting the lowest headroom voltage from a plurality of headroom voltages corresponding to the plurality of LED groups as the feedback voltage.

22. The control method of claim 18, wherein the feedback voltage is selected from headroom voltages corresponding to the light source module.

23. The control method of claim 18, wherein the step of adjusting the variable reference voltage according to the current detection signal comprises:

increasing the variable reference voltage when the current detection signal indicates the driving current becomes greater.

24. The control method of claim 18, wherein the step of adjusting the variable reference voltage according to the current detection signal comprises:

decreasing the variable reference voltage when the current detection signal indicates the driving current becomes smaller.

25. The control method of claim 18, wherein the step of adjusting the variable reference voltage according to the current detection signal comprises:

generating a reference voltage converting signal according to the current detection signal; and generating the variable reference voltage according to the reference voltage converting signal.

26. A light-emitting diode (LED) device, comprising:

a voltage converter, for converting an input voltage into an output voltage according to a voltage control signal;

a light source module, coupled to the voltage converter;

a variable current source, coupled to the light source module, for generating a driving current to drive the light source module; and a control unit, coupled to the variable current source and the voltage converter, for obtaining a feedback voltage from the light source module and detecting variation situations of the driving current provided by the variable current source to generate a current detection signal;

wherein the control unit adjusts a variable reference voltage according to the current detection signal and generates the voltage control signal according to the feedback voltage and the variable reference voltage to the voltage converter.

27. The LED device of claim 26, wherein the light source module comprises a plurality of LED groups and the driving current comprises a plurality of load currents passing through each LED groups respectively.

28. The LED device of claim 27, wherein each LED group of the plurality of LED groups comprises a plurality of LEDs in series.

29. The LED device of claim 27, wherein the control unit generates the current detection signal according to the variation situations of at least one load current of the plurality of load currents having current variation when the current variation of the at least one load current is detected.

30. The LED device of claim 27, wherein the control unit selects the lowest headroom voltage from a plurality of headroom voltages corresponding to the plurality of LED groups as the feedback voltage.

31. The LED device of claim 26, wherein the variable current source generates the driving current according to requirements of the light source module.

32. The LED device of claim 26, wherein the variable current source generates the driving current according to a dimming signal.

33. The LED device of claim 26, wherein the variable current source comprises:

a variable current mirror, coupled to the control unit, for generating the driving current; and a current driving element, coupled to the variable current mirror and the light source module, for controlling the driving current to the light source module.

34. The LED device of claim 33, wherein the control unit detects variation situations of the current provided by the variable current mirror to generate the current detection signal.

35. The LED device of claim 26, wherein the control unit comprises:

a voltage selector, coupled to the light source module, for selecting the feedback voltage from a plurality of headroom voltages corresponding to the light source module;

a current detector, coupled to the variable current source, for detecting variation situations of the driving current generated by the variable current source to generate the current detection signal;

a processing unit, coupled to the current detector, for generating a reference voltage converting signal according to the current detection signal;

a reference voltage converter, coupled to the processing unit, for generating the variable reference voltage according to the reference voltage converting signal;

an error amplifier, coupled to the voltage selector and the reference voltage generator, for generating an error voltage signal according to the feedback voltage and the variable reference voltage; and a conversion controller, coupled to the error amplifier and the voltage converter, for generating the voltage control signal according to the error voltage signal for the voltage converter.

36. The LED device of claim 35, wherein the voltage selector selects the lowest headroom voltage from the plurality of headroom voltages as the feedback voltage.

37. The LED device of claim 35, wherein the processing unit increases the variable reference voltage when the current detection signal indicates the driving current becomes greater.

38. The LED device of claim 35, wherein the processing unit decreases the variable reference voltage when the current detection signal indicates the driving current becomes smaller.

* * * * *